US008316807B2

(12) United States Patent
Methley et al.

(10) Patent No.: US 8,316,807 B2
(45) Date of Patent: Nov. 27, 2012

(54) ENGINE VALVE SYSTEM WITH VARIABLE LIFT AND DURATION

(76) Inventors: Ian Methley, Witney (GB); Nicholas James Lawrence, Buckinghamshire (GB)

( * ) Notice: Subject to any disclaimer, the term of this patent is extended or adjusted under 35 U.S.C. 154(b) by 235 days.

(21) Appl. No.: 12/896,996

(22) Filed: Oct. 4, 2010

(65) Prior Publication Data

US 2011/0017158 A1 Jan. 27, 2011

Related U.S. Application Data

(63) Continuation of application No. PCT/GB2009/050266, filed on Mar. 23, 2009.

(30) Foreign Application Priority Data

Apr. 4, 2008 (GB) ..... 0806116.0

(51) Int. Cl.
*F01L 1/34* (2006.01)

(52) U.S. Cl. ..... 123/90.16; 123/90.39

(58) Field of Classification Search ..... 123/90.16, 123/90.39; 74/559, 569
See application file for complete search history.

(56) References Cited

U.S. PATENT DOCUMENTS 6,584,943 B1 * 7/2003 Klotz ..... 123/90.16

FOREIGN PATENT DOCUMENTS

| | | |
|---|---|---|
| EP | 0 355 659 | 2/1990 |
| EP | 1 264 967 | 12/2002 |
| GB | 2 378 729 | 2/2003 |

OTHER PUBLICATIONS

International Search Report of PCT/GB2009/050266.

* cited by examiner

*Primary Examiner* — Zelalem Eshete
(74) *Attorney, Agent, or Firm* — Mayback & Hoffman; Gregory L. Mayback

(57) ABSTRACT

An improvement is disclosed for an engine valve system with variable lift and duration of the type that includes two cams mounted coaxially, a summation rocker coupled to cam followers in contact with both cams and movable in proportion to the instantaneous sum of the lifts of the respective cams, and a valve actuating rocker pivotably coupled to the summation rocker and serving to open an engine valve in dependence upon the movement of the summation rocker. In the invention, at least one of the couplings of the summation rocker with the cam followers and with the valve actuating rocker incorporates an adjustable eccentric which is rotatable to enable the clearance within the valve system to be set.

20 Claims, 4 Drawing Sheets

ENGINE VALVE SYSTEM WITH VARIABLE LIFT AND DURATION

CROSS-REFERENCE TO RELATED APPLICATION

This is a continuing application, under 35 U.S.C. §§120 and 363, of copending international application No. PCT/GB2009/050266, filed Mar. 23, 2009, which designated the United States and was published in English; this application also claims the priority, under 35 U.S.C. §119, of GB patent application No. 0806116.0, filed Apr. 4, 2008; the prior applications are herewith incorporated by reference in their entirety.

FIELD OF THE INVENTION

The invention relates to an engine valve system that uses two cams to act on a valve by way of a summation mechanism.

BACKGROUND OF THE INVENTION

FIG. 1 shows a cam summation engine valve system as disclosed in U.S. Pat. No. 6,941,910. The valve system includes two cams 10 and 12 and a cam summation rocker 14, herein also termed an "upper rocker," having cam followers 16 and 18 in contact with both cams. A lower actuating rocker 20 is pivotably connected to the summation rocker 14 and acts, at one end, on a valve 22, with its other end resting on a hydraulic lash adjuster 24. An adjustable stop plate 26 is used to limit the expansion of the hydraulic lash adjuster 24 by setting the height of the pivot shaft 30 that connects the lower rocker 20 to the upper rocker 14. The position of the lower rocker 20 is therefore defined by its contact with the tip of the valve 22, and the expansion of the hydraulic lash adjuster 24 holding the pivot shaft 30 against the adjustable stop plate 26.

Cam summation valve systems using hydraulic lash adjusters have required an adjustable stop, or a graded shim in order for the system clearance (and hence the valve lift) to be adjusted. The functions of this clearance adjustment are twofold. First, the expansion of the hydraulic lash adjusters is limited so that the correct amount of clearance is maintained in the system while the valves are closed. Second, the valve actuating rocker is held in contact with the tip of the valve by the expansion of the hydraulic lash adjusters and the clearance adjustment system so that any clearance must occur between one of the cam profiles and its respective follower(s).

G.B. Patent Application No. 0708967.5 (WO2008/139221), by the instant Applicants, describes a cam summation engine valve system as shown in FIG. 2. This figure shows a similar valve system to that shown in FIG. 1. In both drawings, like parts have been allocated the same reference numerals to avoid repetition. In FIG. 2, the valve actuating lower rocker 20 is mounted on a manually-adjustable pivot 32. The valve lift is adjustable through a screw mechanism 34 and contact is maintained between the tip of the valve 22 and the lower rocker 20 at all times through a control spring 36.

This configuration replaces the hydraulic-lash-adjusting elements with a mechanical clearance adjustment and maintains the correct amount of clearance in the system while the valves are closed. However, an adjustable pivot 32 is required to allow the amount of clearance in the system to be adjusted. In the absence of such adjustability, there would be no way to compensate for manufacturing tolerances, which may lead to significant variations in valve lift between cylinders, and potentially damaging impact forces between the components of the system. While it provides for clearance adjustment, the system of G.B. Patent Application No. 0708967.5 requires a significant amount of packaging space that may not be available in all engines.

Therefore, a need exists to overcome the problems with the prior art as discussed above.

SUMMARY OF THE INVENTION

The invention provides an engine valve system with variable lift & duration that overcomes the hereinafore-mentioned disadvantages of the heretofore-known devices and methods of this general type and that provides a more compact adjustment system, which, nevertheless, retains all of the benefits of manual adjustment.

With the foregoing and other objects in view, there is provided, in accordance with the invention, an engine valve system that includes a first cam, a second cam mounted coaxially with the first cam, a summation rocker adjacent to the first cam and the second cam, a first cam follower coupled to the summation rocker, in mechanical communication with the first cam, and movable in proportion to an instantaneous sum of a lift of the first cam, and a second cam follower coupled to the summation rocker, in mechanical communication with the second cam, and movable in proportion to an instantaneous sum of a lift of the second cam. The engine valve system further includes a valve-actuating rocker pivotably coupled to the summation rocker and operable to open an engine valve in dependence upon a movement of the summation rocker and an eccentric coupling the summation rocker to at least one of the first cam follower, the second cam follower, and the valve-actuating rocker, wherein the eccentric is adjustably rotatably operable to adjust a clearance between at least two components within the engine valve system.

In accordance with a further feature of the present invention, the eccentric forms at least a portion of the coupling between the summation rocker and the valve-actuating rocker.

In accordance with another feature, an embodiment of the present invention includes an adjusting mechanism mechanically coupled to and operable to select an angular position of the eccentric with respect to the valve-actuating rocker.

In accordance with an additional feature, an embodiment of the present invention includes an adjusting mechanism mechanically coupled to and operable to select an angular position of the eccentric with respect to the summation rocker.

In accordance with a further feature of the present invention, the eccentric forms at least a portion of the coupling between the summation rocker and at least one of the first cam follower and the second cam follower.

In accordance with another feature, an embodiment of the present invention also includes an adjustably lockable screw mechanism operable to maintain an angular position of the eccentric.

In accordance with a further feature of the present invention, the adjustably lockable screw mechanism is lockable only in predetermined discrete positions.

In accordance with yet another feature, an embodiment of the present invention includes a compliant member operable to prevent rotation of the screw mechanism while the engine valve system is in operation.

In accordance with a further feature of the present invention, the eccentric has a series of discrete adjustment positions.

In accordance with a yet one more feature of the present invention, the eccentric is maintained in a discrete position by the action of a compliant member.

In accordance still with an embodiment of the present invention, an engine valve system includes two cams mounted coaxially, a summation rocker coupled to cam followers in contact with both cams and movable in proportion to the instantaneous sum of the lifts of the respective cams, and a valve actuating rocker pivotably coupled to the summation rocker and operative to open an engine valve in dependence upon the movement of the summation rocker, wherein at least one of the couplings of the summation rocker with the cam followers and with the valve actuating rocker incorporates an adjustable eccentric which is rotatable to enable the clearance within the valve system to be set.

The present invention advantageously utilizes manual clearance adjustments for a cam summation system to provide clearance in the rocker system at a point in its motion cycle. By comparison, if hydraulic elements are used, their expansion needs to be limited. Many of the advantages that hydraulic elements offer in a conventional valve train are not relevant to cam summation systems, where the expansion of the elements is limited by a manual adjustment or a shim. As a manual adjustment method is already required, it is advantageous to apply the adjustment directly to the valve train system, instead of controlling the position of the valve train components indirectly by limiting the expansion of a hydraulic element.

Embodiments of the invention provide a manual adjustment system that is incorporated into the rocker mechanism and may be adjusted while the valve system is assembled into the engine. As with the invention described in G.B. Patent Application No. 0708967.5, the system uses a control spring to maintain contact between the lower rocker and valve tip throughout the operating cycle.

An eccentric, i.e. a shaft with two cylindrical surfaces having their axes offset from one another, engaged in the summation lever provides the adjustment of the valve system. This approach offers a lightweight and compact solution for adjusting the system which requires very little additional space compared to the known conventional summation valve systems.

Clearance adjustments may be made without the need to disassemble the camshaft and rocker system. The absence of hydraulic elements in the system means that consistent valve lift measurements can easily be taken and this allows the valve lifts of each cylinder to be adjusted and re-measured directly.

Additional advantages and other features characteristic of the present invention will be set forth in the detailed description that follows and may be apparent from the detailed description or may be learned by practice of exemplary embodiments of the invention. Still other advantages of the invention may be realized by any of the instrumentalities, methods, or combinations particularly pointed out in the claims.

Although the invention is illustrated and described herein as embodied in an engine valve system with variable lift & duration, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention. The figures of the drawings are not drawn to scale.

DETAILED DESCRIPTION OF THE INVENTION

Figure 1:
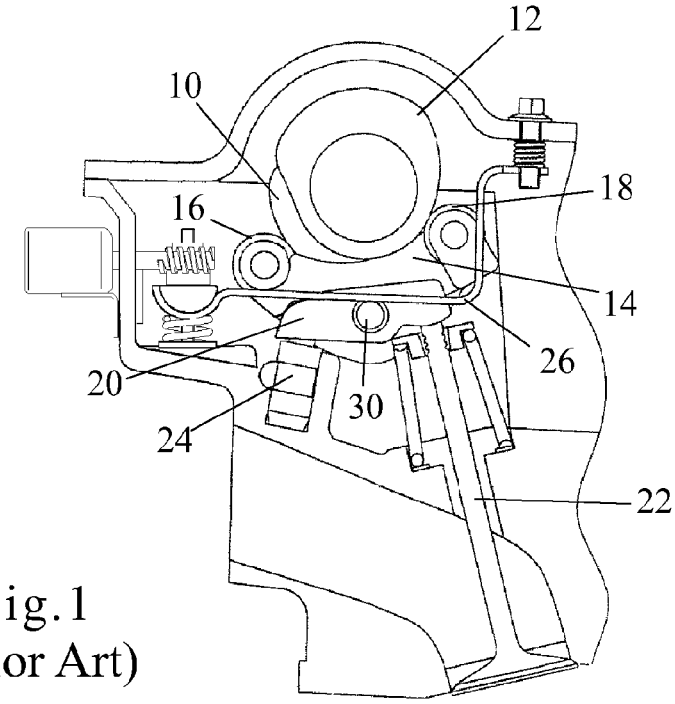
Fig.1 (Prior Art)
FIG. 1 is an elevational side view of the prior-art valve system of U.S. Pat. No. 6,941,910.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

Referring now to FIGS. 3A through 3E, one embodiment of the present invention is several views. FIGS. 3A through 3E show several advantageous features of the present invention, but, as will be described below, the invention can be provided in several shapes, sizes, combinations of features and components, and varying numbers and functions of the components.

Figure 2:
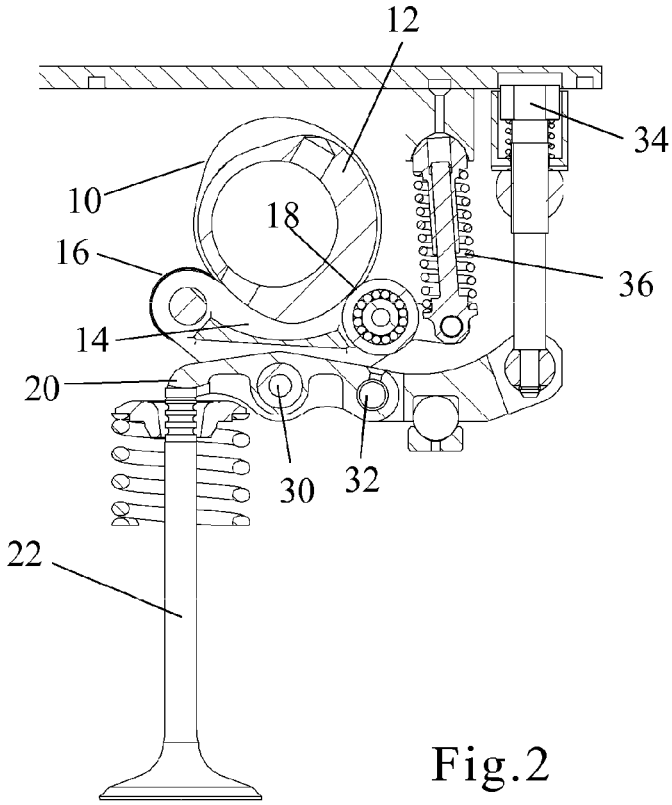
FIG. 2 is an elevational side view of the valve system described in G.B. Patent Application No. 0708967.5 (WO2008/139221).

The first embodiment of the invention, shown in FIGS. 3A to 3E, has many elements in common with the Applicants' G.B. Patent Application No. 0708967.5 (WO2008/139221), shown in FIG. 2. Once again, like reference numerals have been used to designate like components. In particular, an upper rocker 14 with cam followers 16 and 18 is used to operate two valves 22 and is coupled by a shaft 30 to two lower rockers 20 which actuate the respective valves 22. The lower rockers are, in this case, supported at their ends remote from the valves 22 on fixed pivot posts 132. A control spring 36 urges the upper rocker 14 downwards so that the lower rockers 20 are kept in contact with the valves 22 at all times. The control spring 36 also biases the upper rocker 14 clockwise as viewed so that the cam follower 16 is maintained in contact with its associated cam lobe at all times and the clearance in the system when the valves are closed and the cam followers are both on the base circles of their cams is developed between the cam follower 18 and its associated cam lobe.

The pivot shaft 30 that connects the lower rockers 20 to the summation rocker 14 is formed as an eccentric. The axis of the part of the pivot shaft 30 in contact with summation rocker 14 is offset from the axis of the part engaged in the two lower rockers 20. This allows the position of the summation rocker 14 to be adjusted with respect to the valve actuating rockers 20 by rotation of the pivot shaft.

Figure 3A:
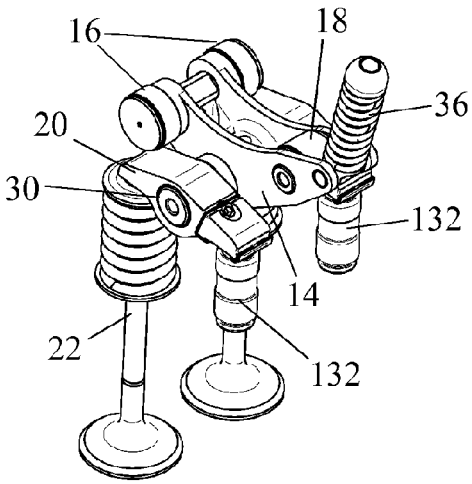
FIG. 3A is a perspective view of a valve system of a first embodiment of the invention shown in its assembled state.
Figure 3B:
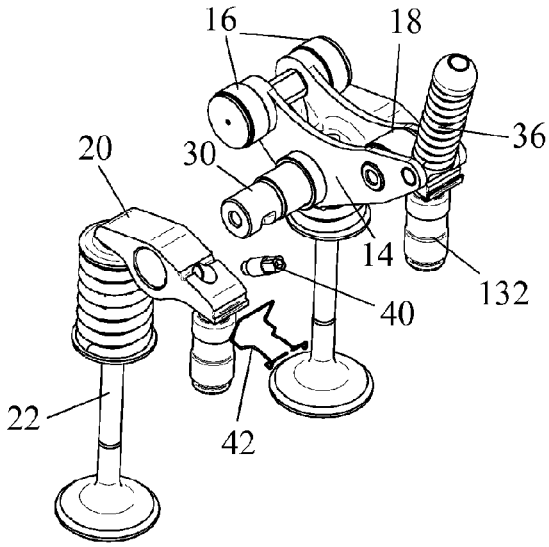
FIG. 3B is a partially exploded perspective view of the valve system of FIG. 3A.
Figure 3D:
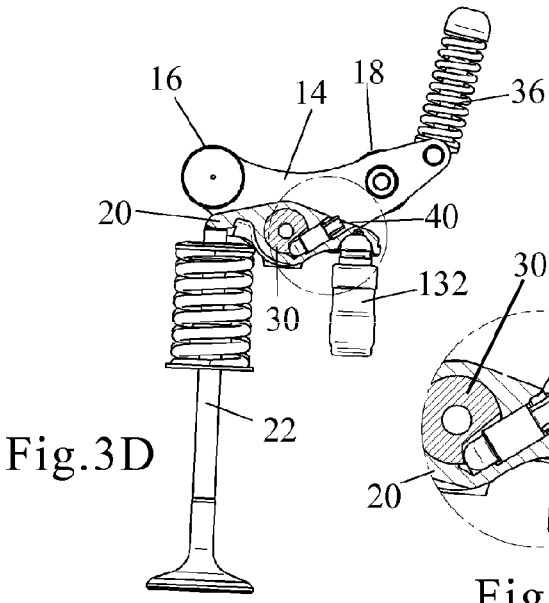
FIG. 3D is an elevational view of a section on the line I-I in FIG. 3C.
Figure 3E:
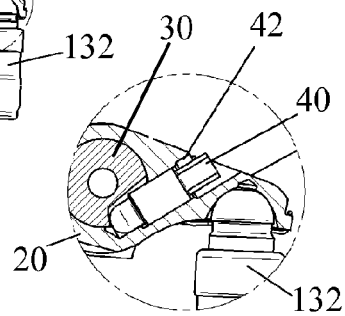
FIG. 3E is a partial view of the section of FIG. 3D drawn to an enlarged scale.
Figure 3C:
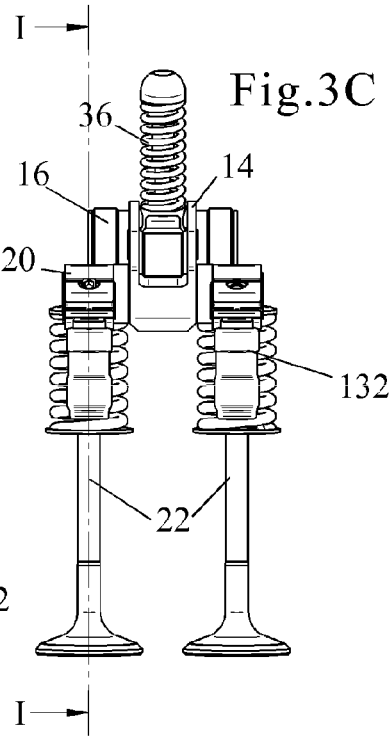
FIG. 3C is an elevational end view of the valve system of FIGS. 3A and 3B.

In order to set the position of the pivot shaft 30, one of the valve actuating rockers 20 is fitted with an adjusting screw 40 that engages in a recess in the pivot shaft 30 as shown best in the detail view of FIG. 3E. The pivot shaft 30 is subjected to a unidirectional torque while the valves are being actuated and so it is only necessary for the adjusting screw to react against this torque which will hold the face of the recess in the pivot shaft 30 in contact with the tip of the adjusting screw 40. The eccentricity of the pivot shaft 30 used to give an acceptable adjustment range will be less than about 1 mm, and hence, the force on the screw need only be very modest to resist the resulting torque.

The detail view of FIG. 3E provides a detailed view of the adjusting mechanism. The adjusting screw 40 engages in the profiled recess in the pivot shaft 30 and is threaded into the valve-actuating rocker 20. In order to prevent any rotation of the adjusting screw 40 while the system is in operation, the upper section of the screw is formed with a square section. A retaining spring 42 (see FIG. 3B), which is used to clip the valve-actuating rocker 20 onto its fixed pivot post 132, engages with a flat side of the adjusting screw 40 such that turning the screw deflects the spring. While this allows the screw to be intentionally adjusted, the spring force will prevent the screw from rotating during operation due to vibration.

An additional embodiment of the invention, shown in FIGS. 4A through 4E, uses the same adjustment principle as the previously-described embodiment, but, instead of locating an adjustment screw 40 in the valve actuator, an analogous adjustment screw 40' is incorporated into the summation rocker 14. This configuration could be advantageous in some applications where the cylinder head configuration prevents easy access to an adjusting screw located in the valve-actuating rocker 20.

Figure 4A:
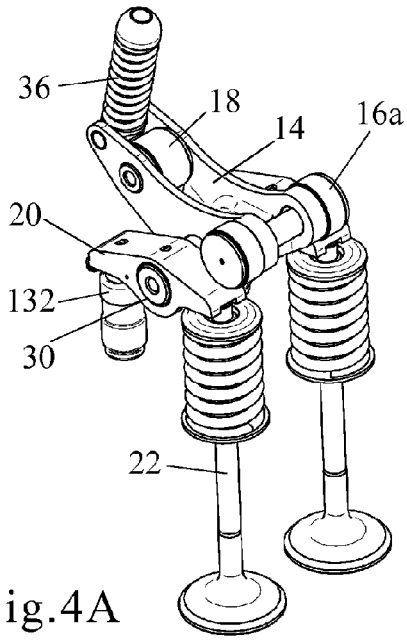
FIG. 4A is a perspective view of a valve system of a second embodiment of the invention shown in its assembled state.
Figure 4B:
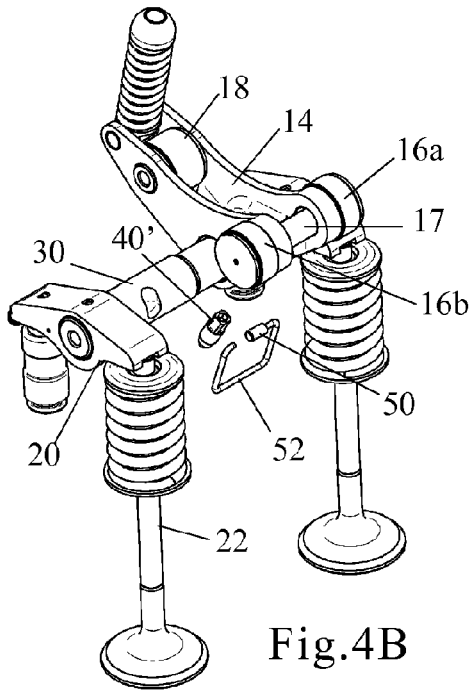
FIG. 4B is a partially exploded perspective view of the valve system of FIG. 4A.
Figure 4D:
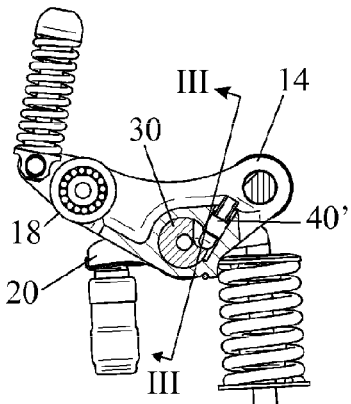
FIG. 4D is a section taken along the line II-II in FIG. 4C.
Figure 4C:
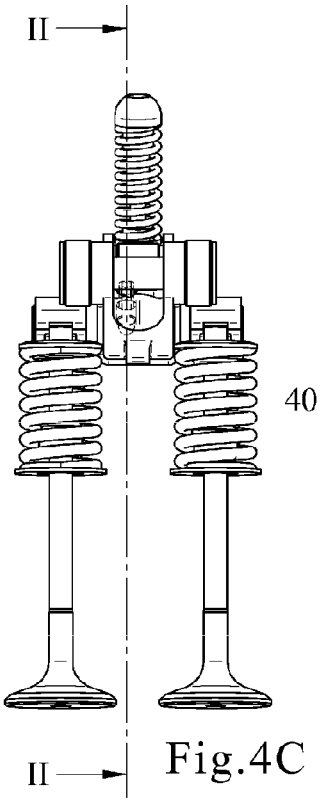
FIG. 4C is an elevational end view of the valve system of FIGS. 4A and 4B.
Figure 4E:
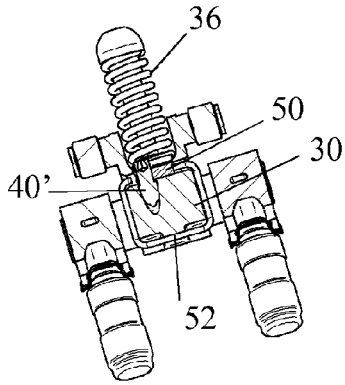
FIG. 4E is a section taken along the line III-III in FIG. 4D.

As with the previous embodiment, the pivot shaft 30 has a recess which is engaged by the adjustment screw 40', as shown in FIG. 4D. The adjustment screw 40', once again, has a square section on its upper portion to allow it to be locked in a simple manner and to prevent it from turning when the engine is operating. In this case, the screw 40' is locked by a sliding plunger 50 which mates with the flat faces on the screw 40', and a spring clip 52 that locates around the summation rocker 14 and urges the plunger into its bore so that it remains in contact with the screw 40'.

The screw 40' may be accessed via the clearance between the camshaft and the central portion of the axle 17 for the two cam followers 16*a* and 16*b* using a small hexagon key. The configuration allows the valve system clearance to be set directly using a feeler gauge to measure the clearance between the single cam follower 18 and its cam lobe.

A further embodiment of the invention, which is shown in FIGS. 5A through 5E, incorporates an eccentric in a shaft coupling the cam follower 18 to the summation rocker 14. The clearance between the cam follower 18 and its respective cam lobe may be adjusted by directly rotating an axle pin 60 mounted on the summation rocker 14. The axle pin 60 has aligned cylindrical surfaces which engage aligned mounting holes 62 in the summation rocker 14 and a non-coaxial cylindrical surface that acts as a race for the cam follower 18 which is constructed as a needle bearing. The aligned cylindrical surfaces on opposite sides of the eccentric surface and the two holes 62 are of different size to permit the axle pin 60 to be slid into position. The axle pin 60 would otherwise either not be able to pass through one of the holes 62 or through the centre of the cam follower 18.

The axle pin 60 has an enlarged head 70 which is centrally recessed to receive an implement, such as a hexagon key, to enable it to be turned. Such rotation alters the position of the eccentric cylindrical surface and sets the clearance in the valve system.

Figure 5A:
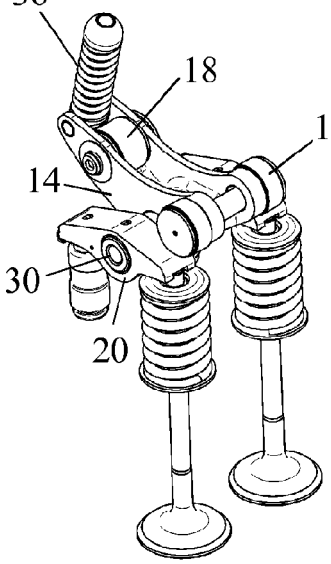
FIG. 5A is a perspective view of a valve system of a third embodiment of the invention shown in its assembled state.
Figure 5B:
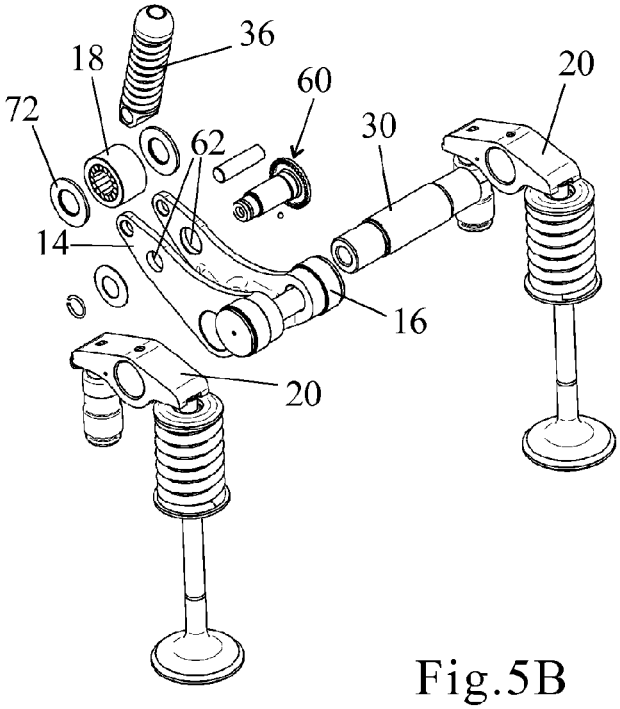
FIG. 5B is a partially exploded perspective view of the valve system of FIG. 5A.
Figure 5C:
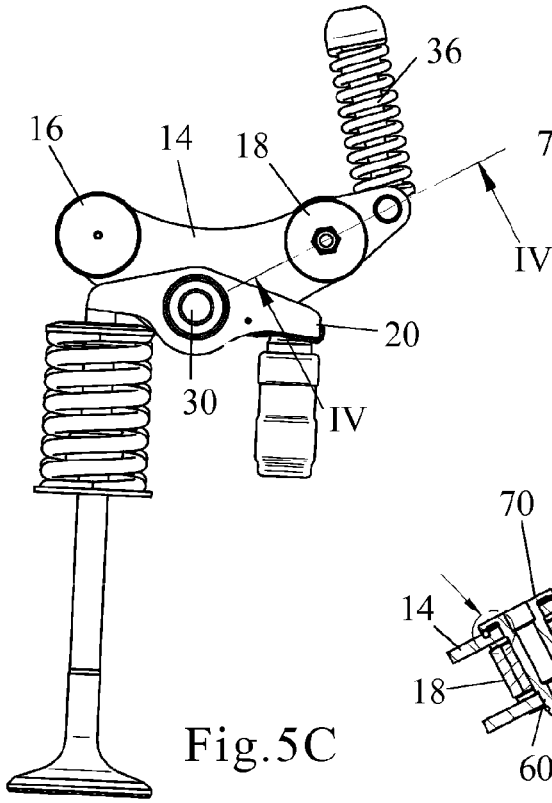
FIG. 5C is an elevational side view of the valve system of FIGS. 5A and 5B.
Figure 5E:
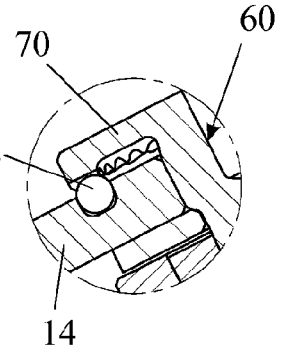
FIG. 5E shows part of the section of FIG. 5D drawn to an enlarged scale.
Figure 5D:
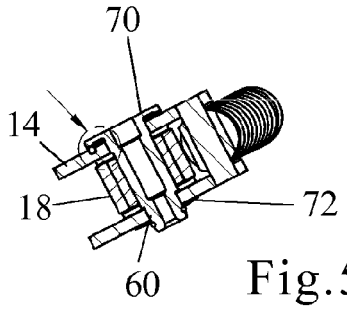
FIG. 5D is a section taken along the line IV-IV in FIG. 5C.

The head 70 is resiliently urged against the side of the summation rocker 14 by a spring disk 72. As best seen in FIG. 5E, the underside of the head 70, that is to say, the side facing the summation rocker 14, is formed with radial corrugations or grooves that engage a ball 74 located in a blind bore in the side of the summation rocker 14. This ball catch mechanism defines predetermined adjustment positions as resistance will be encountered when rotating the head by the need to compress the spring disk 72 as the ball 74 passes from one groove to the next.

The spring disc 72 holds the head 70 firmly in contact with the ball 74 at all times in order to prevent any rotation while the valve system is in operation. As with the eccentric pivot shaft, the rotational forces on the adjuster are modest because it only uses a small eccentric distance.

It will be appreciated that further alternative embodiments may incorporate a pivot shaft having a series of adjustment steps rather than an adjustment screw. A variety of toothed or ratchet-type arrangements could be configured in order to achieve this objective.

The above described embodiments of the invention offer the following advantages as compared to existing configurations:

No hydraulic elements are required.

No graded components such as shims are required as part of the valve system.

The measures for adjustment can be contained within the existing package space for the summation rocker.

The system can be configured such that no significant disassembly is required to adjust the valve lift.

Simple and repeatable measurement methods may be used to check valve lift.

Adjustments may be made and checked instantly.

The foregoing description and accompanying drawings illustrate the principles, exemplary embodiments, and modes of operation of the invention. However, the invention should not be construed as being limited to the particular embodiments discussed above. Additional variations of the embodiments discussed above will be appreciated by those skilled in the art and the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. An engine valve system comprising:

a first cam;

a second cam mounted coaxially with the first cam;

a summation rocker adjacent to the first cam and the second cam;

a first cam follower coupled to the summation rocker and in mechanical communication with the first cam;

a second cam follower coupled to the summation rocker and in mechanical communication with the second cam;

a valve-actuating rocker pivotably coupled to the summation rocker and operable to open an engine valve in dependence upon a movement of the summation rocker; and an eccentric coupling the summation rocker to at least one of the first cam follower, the second cam follower, and the valve-actuating rocker, wherein the summation rocker moves in proportion to an instantaneous sum of a lift of the first cam and the second cam and the eccentric is adjustably rotatably operable to adjust a clearance between at least two components within the engine valve system.

2. The engine valve system recited in claim 1, wherein the eccentric forms at least a portion of the coupling between the summation rocker and the valve-actuating rocker.

3. The engine valve system recited in claim 2, further comprising:

an adjusting mechanism mechanically coupled to and operable to select an angular position of the eccentric with respect to the valve-actuating rocker.

4. The engine valve system recited in claim 2, further comprising:

an adjusting mechanism mechanically coupled to and operable to select an angular position of the eccentric with respect to the summation rocker.

5. The engine valve system recited in claim 1, wherein the eccentric forms at least a portion of the coupling between the summation rocker and at least one of the first cam follower and the second cam follower.

6. The engine valve system recited in claim 1, further comprising:

an adjustably lockable screw mechanism operable to maintain an angular position of the eccentric.

7. The engine valve system recited in claim 6, wherein the adjustably lockable screw mechanism is lockable only in predetermined discrete positions.

8. The engine valve system recited in claim 6, further comprising:

a compliant member operable to prevent rotation of the screw mechanism while the engine valve system is in operation.

9. The engine valve system recited in claim 1, wherein the eccentric has a series of discrete adjustment positions.

10. The engine valve system recited in claim 9, wherein the eccentric is maintained in a discrete position by the action of a compliant member.

11. An engine valve system comprising:

two cams mounted coaxially, a summation rocker coupled to cam followers in contact with both cams and movable in proportion to the instantaneous sum of the lifts of the respective cams, and a valve actuating rocker pivotably coupled to the summation rocker and operative to open an engine valve in dependence upon the movement of the summation rocker, wherein at least one of the couplings of the summation rocker with the cam followers and with the valve actuating rocker incorporates an adjustable eccentric which is rotatable to enable the clearance within the valve system to be set.

12. The engine valve system recited in claim 11, wherein the eccentric forms part of the coupling between the summation rocker and the valve actuating rocker.

13. The engine valve system recited in claim 12, wherein an adjusting mechanism is provided to set the angular position of the eccentric with respect to the valve actuating rocker.

14. The engine valve system recited in claim 12, wherein an adjusting mechanism is provided to set the angular position of the eccentric with respect to the summation rocker.

15. The engine valve system recited in claim 11, wherein the eccentric forms part of the coupling between the summation rocker and one or more of the cam followers.

16. The engine valve system recited in claim 11, wherein the angular position of the eccentric is adjustable by means of a screw mechanism that is lockable to maintain its setting.

17. The engine valve system recited in claim 16, wherein the screw mechanism is lockable only in predetermined discrete positions.

18. The engine valve system recited in claim 16, wherein a compliant member is provided to prevent unintentional rotation of the screw mechanism whilst the system is in operation.

19. The engine valve system recited in claim 11, wherein the eccentric has a series of discrete adjustment positions.

20. The engine valve system recited in claim 19, wherein the eccentric is maintained in a discrete position by the action of a compliant member.

* * * * *